10/8/85 CP 4,545,828

United States Patent [19]

Schoen et al.

[11] Patent Number: 4,545,828

[45] Date of Patent: Oct. 8, 1985

[54] LOCAL ANNEALING TREATMENT FOR CUBE-ON-EDGE GRAIN ORIENTED SILICON STEEL

[75] Inventors: Jerry W. Schoen, Hamilton; Russel L. Young, Collinsville, both of Ohio

[73] Assignee: Armco Inc., Middletown, Ohio

[21] Appl. No.: 439,909

[22] Filed: Nov. 8, 1982

[51] Int. Cl.[4] ..... H01F 1/04

[52] U.S. Cl. ..... 148/111; 148/112

[58] Field of Search ..... 148/110, 111, 112, 113, 148/121; 219/10.43, 155

[56] References Cited

U.S. PATENT DOCUMENTS

| | | | |
|---|---|---|---|
| 3,990,923 | 11/1976 | Takashina et al. | 148/112 |
| 4,109,127 | 8/1978 | Frungel | 219/10.43 |
| 4,215,259 | 7/1980 | Rudd et al. | 219/10.43 |
| 4,234,776 | 11/1980 | Rudd et al. | 219/10.43 |
| 4,363,677 | 12/1982 | Ichiyama et al. | 148/111 |

FOREIGN PATENT DOCUMENTS

| | | | |
|---|---|---|---|
| 8385 | 5/1980 | European Pat. Off. | 148/112 |
| 652230 | 3/1979 | U.S.S.R. | 148/112 |

OTHER PUBLICATIONS

McGannon, The Making, Shaping and Treating of Steel, 8th Ed., 1964, p. 1060.

*Primary Examiner*—John P. Sheehan

*Attorney, Agent, or Firm*—Frost & Jacobs

[57] ABSTRACT

A process for improving the core loss of cube-on-edge grain oriented silicon steel. At some point in its routing after at least one stage of cold rolling and before the final high temperature anneal during which secondary grain growth occurs, the electrical steel is subjected to local annealing across its rolling direction creating bands of enlarged primary grains. These bands of enlarged primary grains regulate the growth of the secondary cube-on-edge grains in the intermediate unannealed areas of the electrical steel strip during the final high temperature anneal, and are themselves ultimately consumed by the secondary grains, providing a cube-on-edge grain oriented electrical steel with smaller secondary grains and reduced core loss.

4 Claims, 24 Drawing Figures

LOCAL ANNEALING TREATMENT FOR CUBE-ON-EDGE GRAIN ORIENTED SILICON STEEL

TECHNICAL FIELD

The invention relates to a method of improving the core loss of grain oriented electrical steel by local annealing, and more particularly to a method of providing locally annealed bands across the rolling direction of the electrical steel producing bands of enlarged primary grains which serve to regulate the growth of the secondary cube-on-edge grains in the unannealed areas during the final high temperature anneal to reduce the size of the secondary grains in the finally annealed electrical steel and thereby to reduce the core loss of the electrical steel.

BACKGROUND ART

The invention is directed to improving the core loss of cube-on-edge grain oriented electrical steels. In such electrical steels, the body-centered cubes making up the grains or crystals are oriented in a cube-on-edge position, designated (110) [001] in accordance with Miller's Indices.

Cube-on-edge oriented silicon steels are well known in the art and are commonly used in the manufacture of cores for transformers and the like. Cube-on-edge electrical steels are produced by a number of routings typically involving one or more operations of cold rolling and one or more operations of annealing, so as to obtain a cold-rolled strip having a commercial standard thickness. After the cold rolling is completed, the strip may be subjected to a decarburizing anneal and coated with an annealing separator. Thereafter, the sheet is subjected to a high temperature final anneal at a temperature of about 1200° C. As used herein and in the claims, the term "high temperature final anneal" refers to that anneal during which the cube-on-edge texture is produced as the result of secondary grain growth. The now-oriented electrical steel has its easiest axis of magnetization in the rolling direction of the sheet so that it is advantageously used in the manufacture of magnetic cores for transformers and the like.

Various specific routings devised in recent years by prior art workers have resulted in cube-on-edge grain oriented silicon steels having markedly improved magnetic characteristics. As a consequence, such electrical steels are now considered to fall into two basic categories.

The first category is generally referred to as regular grain oriented silicon steel and is made by routings which normally produce a permeability at 796 A/m of less than 1870 with a core loss at 1.7 T and 60 Hz of greater than 0.700 W/lb when the strip thickness is about 0.295 mm.

The second category is generally referred to as high permeability grain oriented silicon steel and is made by routings which normally produce a permeability at 796 A/m of greater than 1870 with a core loss less than 0.700 W/lb (at 1.7 T and 60 Hz) when the strip thickness is about 0.295 mm.

U.S. Pat. No. 3,764,406 is typical of those which set forth routings for regular grain oriented silicon steel. For regular grain oriented silicon steel, a typical melt composition by weight percent may be stated as follows:

C: less than 0.085%
Si: 2%–4%
S and/or Se: 0.015%–0.07%
Mn: 0.02%–0.2%

The balance is iron and those impurities incident to the mode of manufacture.

In a typical but non-limiting routing for regular grain oriented silicon steel, the melt may be cast into ingots and reduced to slabs, continuously cast in slab form or cast directly into coils. The ingots or slabs may be reheated to a temperature of about 1400° C. and hot rolled to hot band thickness. The hot rolling step may be accomplished without reheating, if the ingot or slab is at the required rolling temperature. The hot band is annealed at a temperature of about 980° C. and pickled. Thereafter, the silicon steel may be cold rolled in one or more stages to final gauge and decarburized at a temperature of about 815° C. for a time of about 3 minutes in a wet hydrogen atmosphere with a dew point of about 60° C. The decarburized silicon steel is thereafter provided with an annealing separator, such as a coating of magnesia, and is subjected to a final high temperature box anneal in an atmosphere such as dry hydrogen at a temperature of about 1200° C. to achieve the desired final orientation and magnetic characteristics.

U.S. Pat. Nos. 3,287,183; 3,636,579; 3,873,381; and 3,932,234 are typical of those teaching routings for high-permeability grain oriented silicon steel. A nonlimiting exemplary melt composition for such a silicon steel may be set forth as follows in weight percent:

Si: 2%–4%
C: <0.085%
Al (acid soluble): 0.01%–0.065%
N: 0.003%–0.010%
Mn: 0.03%–0.2%
S: 0.015%–0.07%

The above list includes only the primary constituents; the melt may also contain minor amounts of copper, phosphorus, oxygen and those impurities incident to the mode of manufacture.

In an exemplary, but non-limiting, routing for such high-permeability grain oriented silicon steel, the steps through hot rolling to hot band thickness can be the same as those set forth with respect to regular grain oriented silicon steel. After hot rolling, the steel band is continuously annealed at a temperature of from about 850° C. to about 1200° C. for from about 30 seconds to about 60 minutes in an atmosphere of combusted gas, nitrogen, air or inert gas. The strip is thereafter subjected to a slow cooling to a temperature of from about 850° C. to about 980° C., followed by quenching to ambient temperature. After descaling and pickling, the steel is cold rolled in one or more stages to final gauge, the final cold reduction being from about 65% to about 95%. Thereafter, the steel is continously decarburized in wet hydrogen at a temperature of about 830° C. for about 3 minutes at a due point of about 60° C. The decarburized silicon steel is provided with an annealing separator such as magnesia and is subjected to a final box anneal in an atmosphere of hydrogen at a temperature of about 1200° C.

It is common practice, with respect to both types of grain oriented silicon steels, to provide an insulative coating having a high dielectric strength on the grain oriented silicon steel (in lieu of, or in addition to, a mill glass). The coating is subjected to a continuous anneal at a temperature of about 815° C. for about 3 minutes in order to thermally flatten the steel strip and to cure the insulative coating. Exemplary applied insulative coatings are taught in U.S. Pat. Nos. 3,948,786; 3,996,073; and 3,856,568.

The teachings of the present invention are applicable to both types of grain oriented electrical steels.

The pressure of increasing power costs has demanded that the materials used for transformer cores and the like have the lowest core loss possible. Prior art workers have long addressed this problem and have devised a number of methods to reduce core loss of grain oriented electrical steels.

For example, it is well known that core loss of oriented electrical steels can be decreased by increased volume resistivity, reduced final thickness of the electrical steel, improved orientation of the secondary grains, and by decreased size of the secondary grains. The process of secondary grain growth is regulated by the presence of a dispersed phase comprising such elements as manganese, sulphur, selenium, aluminum, nitrogen, boron, tungsten and molybdenum (and combinations thereof) as well as the grain structure (e.g. primary grain size and crystal texture) of the electrical steel prior to the final high temperature anneal. All of these metallurgical variables must, however, be kept within prescribed limits to attain the optimum core loss in the finished grain oriented electrical steel. Maintaining this metallurgical balance has inhibited the development of materials with core losses closer to the theoretical limits.

Prior art workers have also turned their attention to methods of regulating the size of the secondary grains through the use of local deformation. Local deformation by bending prior to the final anneal so as to regulate the size of the cube-on-edge grains has been taught. This method, however, is difficult to employ in practice because of the difficulty of the bending operation.

U.S. Pat. No. 3,990,923 teaches a number of methods of local working of the electrical steel surface by local plastic working employing shot peening or rolling with grooved rolls. This reference also teaches local thermal working employing an electron beam or laser irradiation. Both the mechanical and thermal working techniques taught in this reference produce finer primary grains in the worked bands immediately after the treatment. Such local working methods serve to increase the amount of stored energy in the locally worked bands, and must be limited to a depth of about 70 μm (0.04 mils) in order to regulate secondary grain growth during the final high temperature anneal. Again, the techniques taught in this reference are difficult to employ in practice, particularly at line speeds.

The present invention is based on the discovery that if the cube-on-edge grain oriented electrical steel is subjected to local annealing after at least one stage of cold rolling and before the final high temperature anneal, bands of enlarged primary grains are produced which regulate the growth of the secondary cube-on-edge grains in the intermediate unannealed areas of the electrical steel during the final high temperature anneal. This procedure reduces the amount of stored energy within the locally annealed bands which results in an enlargement of the primary grains within the locally annealed bands and throughout the thickness of the strip. The enlarged primary grains in the annealed bands are, themselves, ultimately consumed by the secondary grains. As a result, a cube-on-edge grain oriented electrical steel with smaller secondary grains and reduced core loss is produced.

The local annealing treatment of the present invention is rapid, and an annealed band across the full strip width can be formed in less than one second. Therefore, it can be readily inserted in the pre-existing process technology and appropriately adapted to line speeds. The local annealing step is easy to regulate since the annealing is controlled by such factors as heat input to the annealed band, time and percent reduction in the cold rolling prior to the local annealing treatment. The resulting smaller secondary grain size and accompanying reduced core loss values are stable and will be unaffected by subsequent stress relief annealing or the like.

DISCLOSURE OF THE INVENTION

According to the invention, there is provided a local annealing treatment for both regular and high-permeability cube-on-edge grain oriented electrical steels to improve the core loss thereof. At some point in the routing of such electrical steels, after at least one stage of cold rolling and before the final high temperature anneal during which secondary grain growth occurs, the electrical steel is subjected to local annealing across its rolling direction, resulting in bands of enlarged primary grains. The bands of enlarged primary grains regulate the growth of the secondary cube-on-edge grains in the intermediate unannealed areas of the electrical steel strip during the final high temperature anneal. The enlarged primary grains of the annealed bands are, themselves, ultimately consumed by the secondary grains resulting in a cube-on-edge grain oriented electrical steel with smaller secondary grains and reduced core loss.

The primary grain size in the locally annealed areas should be at least 30% and preferably at least 50% larger than the primary grain size in the unannealed areas. The length of the locally annealed bands, along the rolling direction, should be from about 0.5 mm to about 2.5 mm. The length of the unannealed regions in the rolling direction should be at least about 3 mm so that orientation development in the unannealed regions is not inhibited or damaged during the final high temperature anneal.

The local annealing step of the present invention can be accomplished by radio frequency resistance heating or radio frequency induction heating, as will be described hereinafter.

DETAILED DESCRIPTION OF THE INVENTION

As a result of prior research conducted into the phenomenon of secondary grain growth, it is known that primary grain size influences the nucleation, growth and resultant size of the secondary grains in a finished strip of cube-on-edge grain oriented electrical steel. It is also known that, during the final high temperature anneal, the temperature at which secondary grain growth initiates will increase with an increase in the size of the primary grains within the strip prior to the high temperature final anneal. The present invention provides a method of utilizing these factors to influence secondary grain growth and control the size of the secondary grains by local modification of the primary grain structure using the novel technical concept of local annealing of the grain oriented electrical steel.

As indicated above, the starting material of the present invention is an electrical steel suitable for the manufacture of regular grain oriented electrical steel or high-permeability grain oriented electrical steel. The electrical steel contains silicon in an amount less than 6.5% together with certain necessary additions such as manganese, sulphur, selenium, aluminum, nitrogen, boron, tungsten, molybdenum and the like, or combinations thereof, to provide a dispersed phase according to the teachings of the art. The electrical steel is fabricated into coils of hot band thickness by any of the appropriate and well known processes and is thereafter subjected to one or more cold rolling operations and, if necessary, one or more operations of annealing so as to produce a strip of standard thickness. After the cold rolling operation is completed, the electrical steel strip may require decarburization in a wet hydrogen atmosphere, as is well known in the art. Thereafter, the grain orientation is developed in the electrical steel strip by a final high temperature anneal at about 1200° C.

According to the present invention, the electrical steel strip is subjected to local annealing resulting in annealed bands extending across the strip with intermediate unannealed areas of the strip. This local annealing can be accomplished by any appropriate method. Two excellent methods for this purpose are radio frequency resistance heating and radio frequency induction heating, as will be described hereinafter.

The local annealing can be accomplished at substantially any point in the routing of the electrical steel after at least one stage of cold rolling and before the final high temperature anneal. Thus, the local annealing could be performed at some intermediate step in the cold rolling process, after cold rolling is completed, or after the decarburizing anneal, if practiced.

Figure 1:
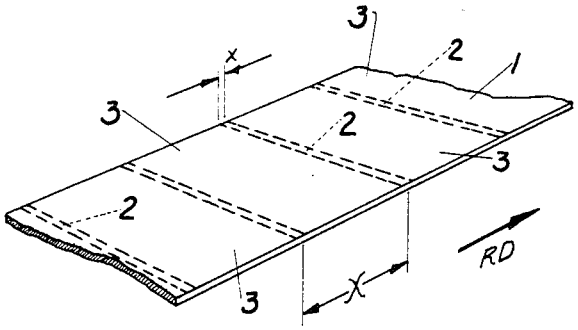
FIG. 1 is a fragmentary, semi-diagrammatic, perspective view of a grain oriented electrical steel strip prior to the final high temperature anneal, illustrating the locally annealed bands thereof in accordance with the present invention.

In FIG. 1, an electrical steel strip is fragmentarily shown at 1. FIG. 1 is semi-diagrammatic in nature and locally annealed bands of the strip are indicated by broken lines at 2. Intermediate these bands are unannealed areas of the strip indicated at 3. The annealed bands 2 have a length (x) in the rolling direction of strip 1 indicated by arrow RD. The unannealed areas 3 have a length (X) in the rolling direction of strip 1.

Figure 2:
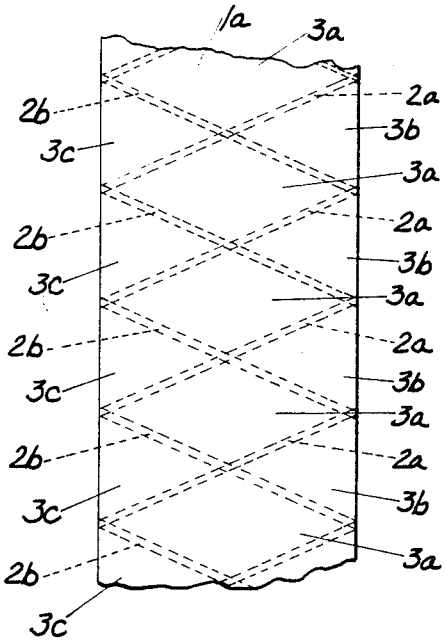
FIGS. 2 and 3 are fragmentary, semi-diagrammatic plan views of grain oriented electrical steel strips prior to the final high temperature anneal, illustrating other angular configurations of annealed bands which could be employed in the practice of the present invention.
Figure 3:
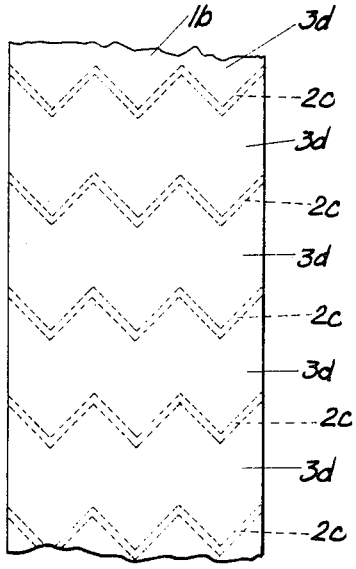

FIG. 1 illustrates a simple instance in which the bands of local annealing 2 extend across the strip in a direction substantially perpendicular to the rolling direction RD. It will be obvious to one skilled in the art that other angles to the rolling direction or other angular configurations of the bands 2 could be employed. For example, in FIG. 2, an electrical steel strip is fragmentarily shown at 1*a* with locally annealed bands 2*a* and 2*b* in a criss-cross pattern on the strip 1*a*. This leaves unannealed areas 3*a*, 3*b* and 3*c*. In FIG. 3, on the other hand, an electrical steel strip is fragmentarily shown at 1*b* having uniformly zigzagged bands of local annealing 2*c* with intermediate unannealed areas 3*d*.

The more critical feature of the present invention is not the geometric relationship of the annealed bands and the unannealed areas of the strip, but rather the values of (x) and (X). The length (x) of the annealed bands must be sufficiently large to temporarily retard the advance of a growing cube-on-edge grain during the final high temperature anneal, while being small enough to ultimately enable complete elimination of the unoriented primary grains in the annealed bands during the heating cycle of the final high temperature anneal. Excellent results have been achieved in instances where the value of (x) was from about 0.5 to about 2.5 mm. The value of (X) should be at least about 3 mm to provide optimum orientation development during the final high temperature anneal.

Figure 4:
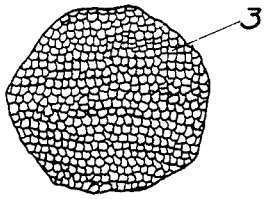
FIG. 4 is a fragmentary schematic view of the microstructure of the untreated areas of the strip of FIG. 1.
Figure 5:
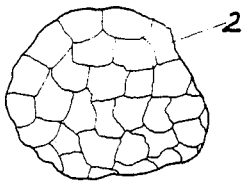
FIG. 5 is a fragmentary schematic view of the microstructure of the locally annealed areas of the strip of FIG. 1.
Figure 6:
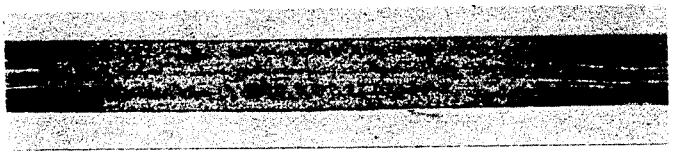
FIG. 6 is a 40× photomicrograph of the microstructural changes created by the local annealing of grain oriented electrical steel after final cold rolling and before decarburization.

FIG. 4 is a diagrammatic representation of the primary grain structure of the unannealed areas of the strip (for example, areas or regions 3 of the strip 1). FIG. 5 is a similar diagrammatic representation of the primary grains within the locally annealed areas or bands of the strip, such as bands 2 of strip 1. FIG. 6 is a 40× photomicrograph illustrating the microstructural changes created by locally annealing the electrical steel after final cold rolling is completed and before decarburization. The central portion of the photomicrograph of FIG. 6 illustrates the microstructure of an annealed band 2, while the end portions of the photomicrograph show the microstructure of adjacent unannealed areas 3.

It will be evident, particularly from FIGS. 4 and 5, that the primary grains of the annealed zone or band 2 are larger than the primary grains of the unannealed areas or regions 3. It has been determined that the primary grain size in the locally annealed bands 2 should be at least 30% (and preferably 50%) larger than the primary grain size in the untreated areas 3. On the other hand, the grains of the locally annealed bands 2 should not be so large that they cannot be ultimately completely consumed by secondary grains during the heating cycle of the final high temperature anneal.

Figure 7:
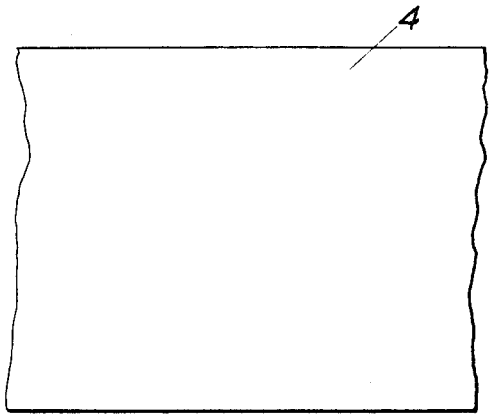
FIGS. 7-12 are fragmentary semi-diagrammatic representations of the secondary grain growth sequence in a strip of electrical steel treated in accordance with the teachings of the present invention and a similar strip of electrical steel not treated in accordance with the teachings of the present invention.
Figure 8:
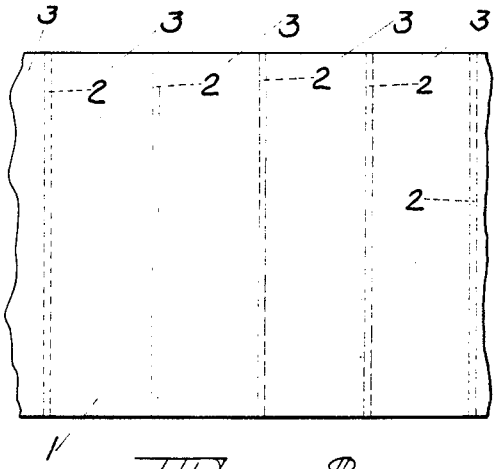
Figure 9:
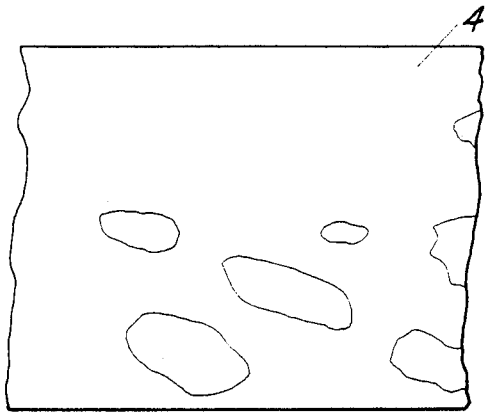
Figure 10:
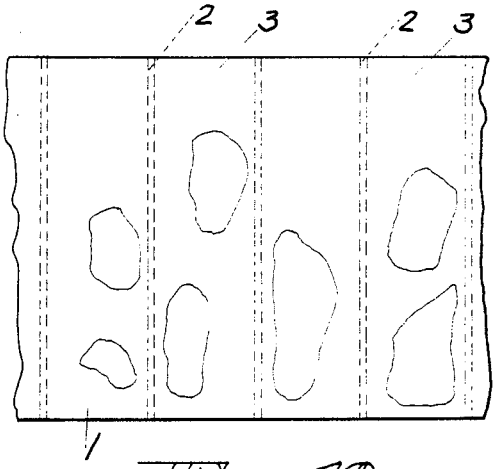

The mechanism by which smaller secondary grains (and thus lower core loss) are achieved in the practice of the present invention is semi-diagrammatically illustrated in FIGS. 7–12. In FIG. 7, a strip of electrical steel is fragmentarily illustrated at 4. The strip 4 has not been locally annealed in accordance with the present invention. FIG. 8, on the other hand, is a fragmentary illustration of electrical steel strip 1 of FIG. 1, showing the alternate locally annealed bands 2 and intermediate unannealed areas 3. In both instances, when the strips 4 and 1 are subjected to a final high temperature anneal, there is no evidence of secondary grain growth up through a temperature of about 800° C. As is indicated in FIGS. 9 and 10, secondary grain growth initiates in both strips 4 and 1 at a temperature of from about 900° C. to about 1000° C. In the untreated strip 4, the secondary grains grow with little restraint on their final dimensions. In the locally annealed strip 1, however, the secondary grains begin to grow in the untreated regions. However, secondary grain growth is not simultaneously initiated in the locally annealed bands because of the enlarged primary grain size therein (see FIG. 5).

Figure 11:
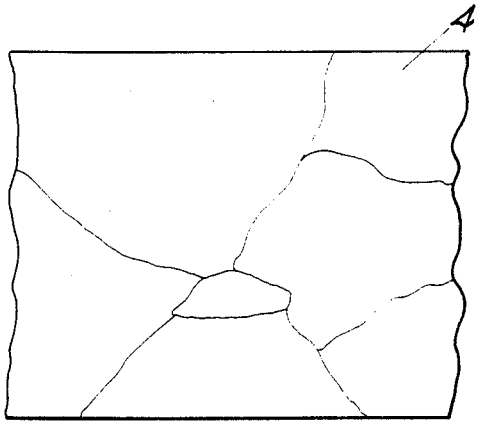
Figure 12:
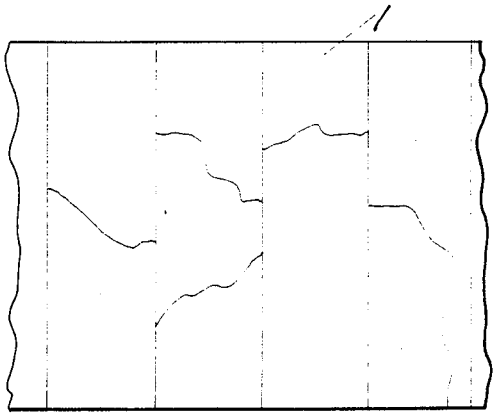

As the temperature of the final anneal reaches from about 1000° C. to about 1100° C., secondary grain growth in untreated strip 4 is substantially complete, most of the primary grains having been consumed. It will be evident from FIG. 11 that the substantially unrestrained secondary grains achieved a rather large size. In the locally annealed strip 1, secondary grain growth is again substantially complete when the temperature reaches from about 1000° C. to about 1100° C. In this instance, however, since secondary grain growth did not simultaneously initiate in the locally annealed bands 2, these locally annealed bands served to temporarily retard the growth of the secondary grains in the untreated regions, allowing additional grains to grow from nuclei which might have otherwise been consumed. Eventually, the secondary grains of the unannealed areas 3 consumed those of the locally annealed areas and secondary grain growth was completed. As is evident from FIG. 12, however, the resulting secondary grains in strip 1 are smaller than those of strip 4 (FIG. 11).

Figure 17:
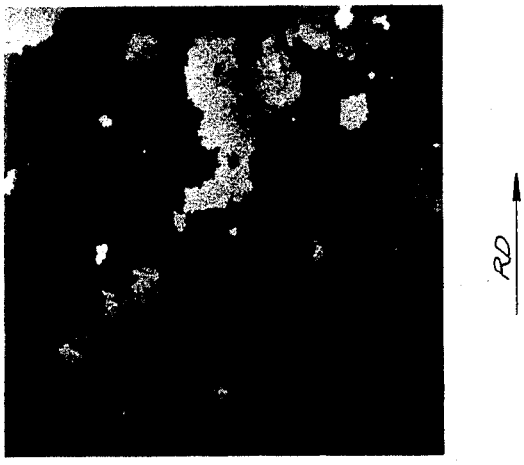
FIG. 17 is a 1× photograph of the secondary grain structure of a cube-on-edge grain oriented electrical steel sample not having been locally annealed in accordance with the present invention.
Figure 18:
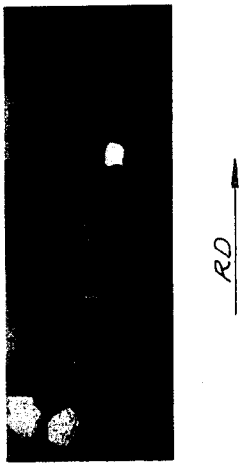
FIG. 18 is a 1× photograph of the secondary grain structure after the final high temperature anneal of a cube-on-edge grain oriented electrical steel sample, similar to the sample of FIG. 17, but having been locally annealed in accordance with the present invention after final cold rolling and before decarburization.

Thus, as is demonstrated by FIGS. 7–12, the local annealing treatment according to the present invention provides a novel means to control the cube-on-edge secondary grain growth of an electrical steel strip. This makes it possible to produce a strip of cube-on-edge grain oriented electrical steel having high magnetic permeability and a final secondary grain size small enough to reduce the core loss. The effectiveness of the process of the present invention is clearly demonstrated in FIGS. 17 and 18. FIG. 17 is a 1× photograph of the cube-on-edge secondary grain structure of an electrical steel sample processed without the local annealing of the present invention. FIG. 18 is a 1× photograph of the cube-on-edge secondary grain structure of a locally annealed electrical steel sample. The samples of FIGS. 17 and 18 were identically processed, with the exception of the local annealing of the sample of FIG 18. As viewed in these Figures, the rolling directions of the samples are indicated by arrows RD. The controlled smaller size of the cube-on-edge secondary grains of the sample of FIG. 18 is readily apparent from that Figure.

In the practice of the present invention, any appropriate annealing means can be used which is capable of producing locally annealed bands having the parameters given above. It has been found, for example, that radio frequency resistance heating or radio frequency induction heating devices can be advantageously and economically employed for the local annealing step, and at line speeds.

Figure 13:
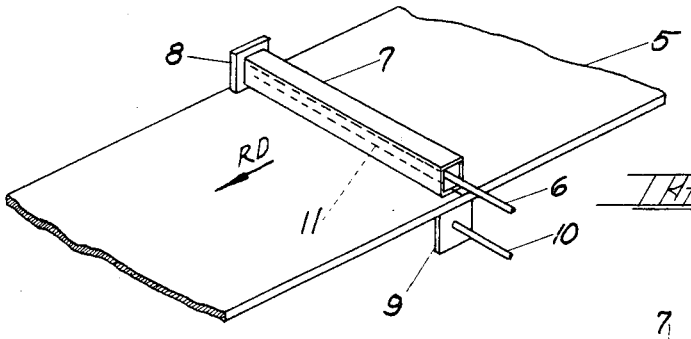
FIG. 13 is a fragmentary, semi-diagrammatic prospective view of a radio frequency resistance heating device for use in the practice of the present invention.
Figure 14:
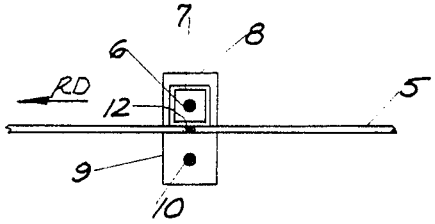
FIG. 14 is a fragmentary end elevational view of the device of FIG. 13.

FIGS. 13 and 14 illustrate an exemplary, non-limiting radio frequency resistance heating assembly. In these Figures, an electrical steel strip is shown at 5 having a rolling direction indicated by arrow RD. In the simple embodiment illustrated in these Figures, a conductor 6 extends transversely across the strip 5 in parallel spaced relationship thereto and enclosed in a casing 7 in contact with the strip. The conductor 6 comprises a proximity conductor and the casing 7 may be made of any appropriate electrically insulating material such as fiberglass, silicon nitride or alumina. The casing 7 may be cooled, if desired, by any appropriate means (not shown). The conductor 6 is connected to a contact 8 of copper or other appropriate conductive material. The contact 8 rides upon strip 5 at the edge of the strip. A second contact 9 is located on that side of strip 5 opposite the contact 8. A conductor 10 is affixed to contact 9. The conductors 6 and 10 are connected across a radio frequency power source (not shown). When power is applied to the device of FIGS. 13 and 14, current will flow in strip 5 between contacts 8 and 9 along a path of travel parallel to proximity conductor 6. This path of travel is shown in broken lines in FIG. 13 at 11. The current in strip 5 will create a localized annealed band in the strip which is shown at 12 in FIG. 14. In the use of the radio frequency resistance heating device of FIGS. 13 and 14, the important parameters comprise the size and shape of the proximity conductor, the distance of proximity conductor 6 from strip 5, treatment time, the frequency and the amount of current.

Figure 15:
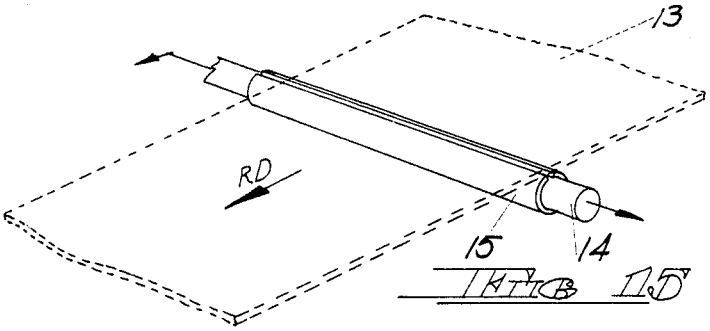
FIG. 15 is a fragmentary semi-diagrammatic prospective view of a radio frequency induction heating device for use in the practice of the present invention.
Figure 16:
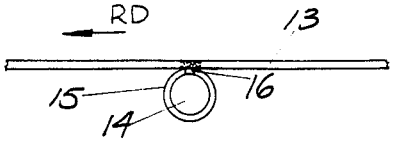
FIG. 16 is an end elevational view of the device of FIG. 15.

A non-limiting radio frequency induction heating device is illustrated in FIGS. 15 and 16. In these Figures, an electrical steel strip is fragmentarily shown at 13 having a rolling direction indicated by arrow RD. The radio frequency induction heating device comprises a conductor 14 of copper or other appropriate conductive material surrounded by a core 15 of appropriate high resistivity magnetic material such as ferrite. The ferrite core 15 has a longitudinally extending slot or gap 16 formed therein which constitutes the inductor core air gap. The conductor 14 is connected across a radio frequency power source (not shown).

A radio frequency current flow in conductor 14 will induce voltages which cause eddy currents to flow in the strip 13. The use of ferrite core 15 and narrow air gap 16 provide a means of annealing narrow bands on strip 13. As in the embodiment of FIGS. 13 and 14, the embodiment of FIGS. 15 and 16 is again shown in its most simple form, producing locally annealed bands extending across the strip and substantially perpendicular to the rolling direction RD. With respect to the radio frequency induction heating device of FIGS. 15 and 16, the important parameters comprise treatment time, gap width, frequency and the amount of current. It has been determined that gap widths of from about 0.076 to about 2.5 mm in the ferrite core produce localized annealed bands meeting the above stated parameters. That portion of core 15 defining gap 16 should be closely adjacent to, and preferably in contact with, the strip 5.

In the radio frequency resistance heating device of FIGS. 13 and 14 and in radio frequency induction heating device of FIGS. 15 and 16, narrow parallel annealed bands are produced by causing the strips 5 and 13 to move in the direction of arrow RD. The individual annealed bands are the result of pulsing the radio frequency current fed to the devices. In the radio frequency induction heating device of FIGS. 15 and 16, parallel spaced annealed bands with the required spacing (X) could be produced by maintaining the radio frequency current in conductor 14 constant while rotating the ferrite core 15. Under these circumstances, the core 15 could have more than one gap 16.

Current frequencies of from about 10 kHz to about 27 MHz are common for radio frequency resistance heating and radio frequency induction heating devices of the type taught above. Such devices are especially suitable for local annealing in high speed commercial applications, owing to the nature of the high frequency currents, the high power output available and the electrical efficiency.

It has additionally been found that the electrical steel strip must be maintained under pressure in excess of 2.5 MPa while being locally annealed, to avoid distortion of the sheet due to the local annealing treatment. For example, in the structure shown in FIGS. 13 and 14, pressure can be maintained on the strip 5 between the casing 7 and a supporting surface (not shown) located beneath the strip. Similarly, in the structure shown in FIGS. 15 and 16, pressure can be maintained on strip 13 between core 15 and a supporting surface (not shown) located above the strip. It will be understood by one skilled in the art that the amount of pressure required to maintain strip flatness will depend upon such variables as strip thickness, strip width, the design of the heating apparatus, etc.

As indicated above, the local annealing step of the present invention can be performed at any point in the routing after at least a first stage of cold rolling and before the final high temperature anneal. A preferred point in the routing is between final cold rolling stage and the decarburization anneal (if required). If the local annealing step is to be performed after the decarburizing anneal, attention must be turned to the possible problem of the formation of a fayalite layer which might cause sticking in the heating equipment and possible damage to the formation of a mill glass during the final high temperature anneal.

EXAMPLE 1

A high-permeability grain oriented electrical steel sheet, containing nominally 0.044% carbon, 2.93% silicon, 0.026% sulphur, 0.080% manganese, 0.034% aluminum and 0.0065% nitrogen (the balance being substantially iron and impurities incident to the mode of manufacture) was subjected to strip annealing at about 1150° C. and cold rolled to a final thickness of about 0.27 mm. After cold rolling, the sheet was subjected to a local annealing treatment using a radio frequency induction heating device (of the type shown in FIGS. 15 and 16) with a ferrite core having a gap of 0.635 mm connected to radio frequency power sources of 450 kHz and 2 MHz. The annealed areas were perpendicular to the rolling direction of the sheet. The length (x) of each annealed band, wherein an enlarged primary grain size was developed, was about 0.90 mm. The length (X) of each of the untreated regions was about 9 mm. After the local annealing treatment, the sheet was subjected to decarburization at 830° C. in a wet hydrogen atmosphere. Microstructural examination showed the primary grain size in the locally annealed bands to be from about 50% to about 70% larger than the primary grains in the untreated areas, after the decarburizing anneal. The electrical steel sheet was further subjected to a final high temperature anneal at 1150° C. after being coated with a magnesia annealing separator. The magnetic properties obtained with the local annealing treatment, as compared to untreated control samples which were not locally annealed but which were the same in all other respects, are summarized in the Table below.

| Sample | Local annealing conditions | | 1.7 T, 60 Hz Core loss |
|---|---|---|---|
| No. | Frequency | Time | (Watts/lb) |
| 1 | 450 kHz | 0.24 sec | .671 |
| 2 | 450 kHz | 0.23 sec | .690 |
| 3 | 450 kHz | 0.10 sec | .682 |
| 4 | 450 kHz | 0.10 sec | .654 Average of |
| 5 | 450 kHz | 0.10 sec | .661 treated samples |
| 6 | 2 MHz | 0.24 sec | .647 .670 W/lb |
| 7 | 2 MHz | 0.24 sec | .697 |
| 8 | 2 MHz | 1.50 sec | .659 |
| 9 | | control | .694 Average of |
| 10 | | control | .659 untreated sam- |
| 11 | | control | .717 ples .690 W/lb |
| 12 | | control | .690 |

FIG. 17 is a 1× photograph of the secondary grain microstructure of control sample 9. FIG. 18 is a 1× photograph of the secondary grain microstructure of sample 1. It will be apparent from these Figures that the length of the secondary grains was reduced by virtue of the local annealing treatment. Furthermore, it is apparent that secondary grain growth can be completely suppressed in the annealed areas. The improved control of the secondary grain size and the reduction thereof in the samples subjected to a local annealing treatment resulted in lower core loss, as shown in the Table. In this example, time represents the measured variable for controlling the energy input. The actual output power measurements are relative to the particular radio frequency induction heating device used and the particular experimental set-up.

EXAMPLE 2

Additional samples of the same cold rolled sheet material used in Example 1 were treated using local annealing to modify the behavior of the secondary grain growth. The sheet samples were locally annealed using both a radio frequency resistance heating device of the type shown in FIGS. 13 and 14 and a radio frequency induction heating device of the type shown in FIGS. 15 and 16. In both instances, the devices were so arranged as to provide annealed bands extending across the samples and substantially perpendicularly to the rolling direction. Various lengths (x) of the locally annealed bands were produced ranging from 1.5 mm to 3 mm. Similarly, various lengths (X) of untreated regions were produced, ranging from 8 to 10 mm. After decarburization at 830° C. in a wet hydrogen atmosphere, the change in the primary grain size of the various samples was determined to have been increased from about 30% to about 50% and up to about 500%. The effect of these treatment variations on the final secondary grain structure is illustrated in FIGS. 19–24.

Figure 19:
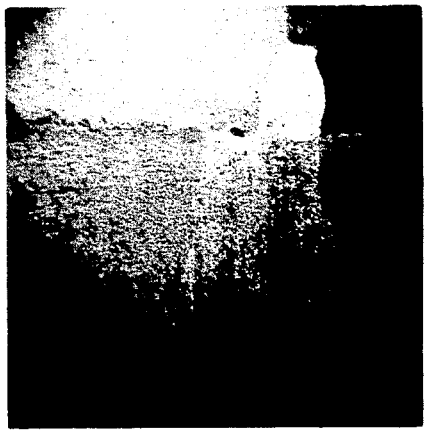
FIGS. 19, 20 and 21 are 3.5× photographs of the secondary grain structure after a final high temperature anneal of cube-on-edge grain oriented electrical steels having been locally annealed after final cold rolling and before decarburization.
Figure 22:
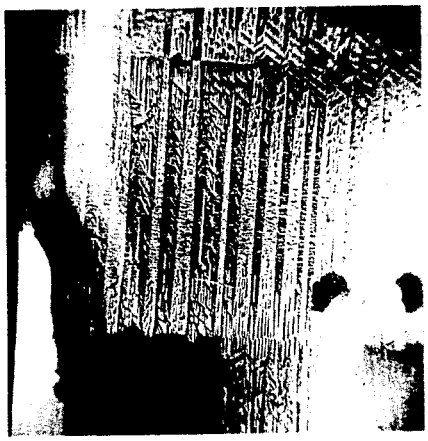
FIGS. 22, 23 and 24 are 3.5× photographs of the magnetic domain structures of the samples of FIGS. 19-21, respectively.

The sample illustrated in FIGS. 19 and 22 had an annealed band length (x) of about 1.5 mm. The primary grain size in the annealed bands was enlarged from about 50% to about 70%, compared with the primary grain size in the untreated regions. With these conditions, secondary grain growth was completely suppressed within the locally annealed bands. In the later portion of the final high temperature annealing cycle, the secondary grains which began to grow in the untreated regions of the sheet eventually consumed the primary grains remaining in the locally annealed bands. This resulted in a very well oriented secondary grain structure, as is evident from FIG. 19 and as is shown in the domain patterns in FIG. 22.

Figure 20:
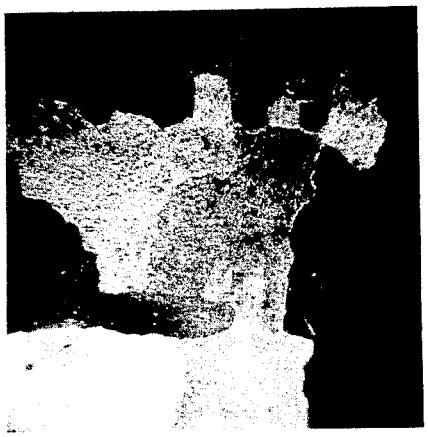
Figure 23:
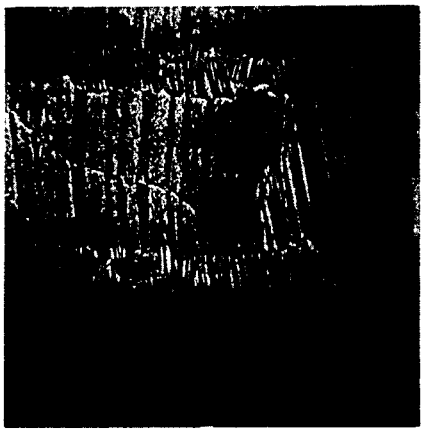

The sample shown in FIGS. 20 and 23 had an annealed band length (x) of about 1.5 mm. The primary grain size in the annealed bands was enlarged from about 30% to about 50%, as compared to the primary grains in the untreated regions of the strip. Under these circumstances, secondary grain growth was not completely suppressed in the untreated regions. Nevertheless, secondary grain growth began at a higher temperature in the bands than in the untreated portions of the sheet. Again, the secondary grain structure was refined. However, as the domain structure shown in FIG. 23 indicates, the secondary grains are less favorably oriented than in the sample of FIGS. 19 and 22. Nevertheless, the core loss was still improved over that of an untreated control sheet.

Figure 21:
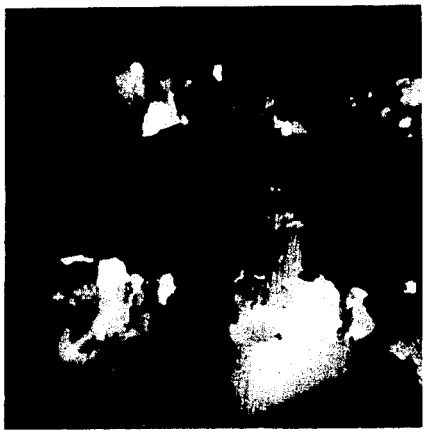
Figure 24:
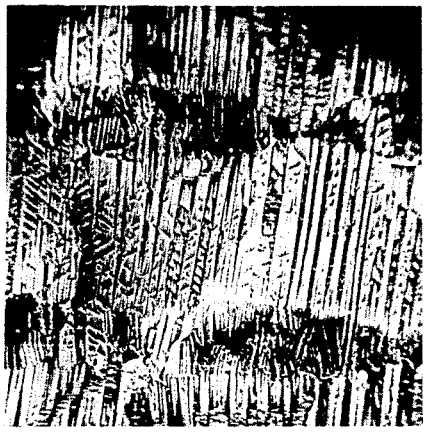

Finally, the sample illustrated in FIGS. 21 and 24 had an annealed band length (x) of about 3.0 mm. In the annealed bands, the primary grain size was enlarged in excess of 500%. Under these circumstances, secondary grain growth during the final high temperature anneal was incomplete. Although secondary grains began to grow in the untreated regions, the excessive size of the primary grains of the annealed bands and the excessive length (x) of the annealed bands prevented the development of a well oriented secondary grain structure. As a result, a sheet treated in this manner has an undesirably high proportion of the less well oriented secondary grains. This is clearly shown in FIG. 24.

Modifications may be made in the invention without departing from the spirit of it.

What is claimed is:

1. A process for controlling secondary grain growth and improving the core loss of cube-on-edge grain oriented electrical steel strip of the type containing less than 6.5% silicon and produced by a routing comprising reduction to hot band thickness, at least two stages of cold rolling, coating with an annealing separator and a high temperature anneal during which the cube-on-edge texture is produced as the result of secondary grain growth, said process comprising the steps of subjecting the steel strip to a local grain growth annealing treatment by either radio frequency induction heating or radio frequency resistance heating at a point in said routing between cold rolling stages to produce parallel bands of annealed regions across the strip with unannealed regions therebetween, said annealed bands containing primary grains at least about 30% larger than those of said unannealed regions, said primary grains of said annealed regions being of such size and said annealed bands having a length in the rolling direction of said strip such that the advance of growing secondary grains in said unannealed regions into said annealed bands is temporarily retarded during the initial portion of said high temperature anneal for secondary grain growth and said enlarged primary grains of said annealed bands are essentially consumed during the final portion of said high temperature anneal for secondary grain growth, whereby said strip, after having been subjected to said high temperature anneal for secondary grain growth, has secondary grains of reduced size and has improved core loss.

2. A process for controlling secondary grain growth and improving the core loss of cube-on-edge grain oriented electrical steel strip of the type containing less than 6.5% silicon and produced by a routing comprising reduction to hot band thickness, at least one stage of cold rolling, a decarburizing anneal after said at least one stage of cold rolling, coating with an annealing separator after said decarburizing anneal and a high temperature anneal during which the cube-on-edge texture is produced as the result of secondary grain growth, said process comprising the steps of subjecting the steel strip to a local grain growth annealing treatment by either radio frequency induction heating or radio frequency resistance heating at a point in said routing after said first stage of cold rolling and before said decarburizing anneal to produce parallel bands of annealed regions across the strip with unannealed regions therebetween, said annealed bands containing primary grains at least about 30% larger than those of said unannealed regions, said primary grains of said annealed regions being of such size and said annealed bands having a length in the rolling direction of said strip such that the advance of growing secondary grains in said unannealed regions into said annealed bands is temporarily retarded during the initial portion of said high temperature anneal for secondary grain growth and said enlarged primary grains of said annealed bands are essentially consumed during the final portion of said high temperature anneal for secondary grain growth, whereby said strip, after having been subjected to said high temperature anneal for secondary grain growth, has secondary grains of reduced size and has improved core loss.

3. The process claimed in claim 1 or claim 2 wherein said length of each said annealed bands in the rolling direction of said strip is from about 0.5 mm to about 2.5 mm and the length of said unannealed regions in the rolling direction of said strip is at least about 3 mm.

4. The process claimed in claim 1 or claim 2 including the step of subjecting said strip to pressure during said local annealing treatment.

* * * * *